United States Patent [19]

Conard et al.

[11] 4,003,659

[45] Jan. 18, 1977

[54] SINGLE PLANE CORNER REFLECTOR GUIDANCE SYSTEM

[75] Inventors: Robert G. Conard, Huntsville, Ala.; Kynric M. Pell, Laramie, Wyo.

[73] Assignee: The United States of America as represented by the Secretary of the Army, Washington, D.C.

[22] Filed: Nov. 15, 1974

[21] Appl. No.: 524,287

[52] U.S. Cl. ..... 356/152; 356/5; 244/3.11

[51] Int. Cl.[2] ..... G01B 11/26; F41G 7/00

[58] Field of Search ..... 356/141, 152, 4, 5; 250/203 R; 244/3.11, 3.13, 3.14

[56] References Cited

UNITED STATES PATENTS

| | | | |
|---|---|---|---|
| 3,098,933 | 7/1963 | Barasch | 250/203 R |
| 3,478,212 | 11/1969 | Turck | 250/203 R |
| 3,574,466 | 4/1971 | Peters | 356/152 |
| 3,698,811 | 10/1972 | Weil | 356/5 |
| 3,731,103 | 5/1973 | O'Meara | 356/5 |
| 3,746,288 | 7/1973 | Schoneborn | 244/3.14 |
| 3,796,396 | 3/1974 | Crovella | 244/3.11 |
| 3,866,229 | 2/1975 | Hammack | 356/141 |

*Primary Examiner*—Maynard R. Wilbur
*Assistant Examiner*—S. C. Buczinski
*Attorney, Agent, or Firm*—Nathan Edelberg; Robert P. Gibson; James T. Deaton

[57] ABSTRACT

A laser attitude detection and guidance system which uses a number of ground base laser transmitter/detector stations and at least two retroreflecting arrays on the missile to track and determine attitude correction signals to be sent for correcting the attitude of the missile relative to a predetermined trajectory.

4 Claims, 2 Drawing Figures

SINGLE PLANE CORNER REFLECTOR GUIDANCE SYSTEM

BACKGROUND OF THE INVENTION

In the missile field, there is a need for an attitude detection and guidance scheme in which the missile contains a minimum amount of equipment for determining the attitude and control of the missile. That is, it is desirable to make the missile components as few and as light in weight as possible and to place the items that are normally expended with the missile on the ground where possible. In present missile systems, gyros and other devices that are relatively expensive and add weight to the missile are utilized. These type systems are not desirable in that the attitude determining mechanisms are destroyed with the missile and too they add weight to the missile itself.

Therefore, it is an object of this invention to provide an attitude detection and guidance system in which the missile carries a minimum amount of equipment and wherein the ground equipment is used in determining the attitude of the missile.

Another object of this invention is to provide an attitude detection system in which continuous wave lasers are used.

Still another object of this invention is to provide an attitude detection and guidance system that utilizes roof reflectors on the missile that reflect continuous wave laser signals to detectors on the ground.

Other objects and advantages of this invention will be obvious to those skilled in this art.

SUMMARY OF THE INVENTION

In accordance with this invention, a laser attitude detection and guidance system is disclosed that includes three laser trackers that are mounted in a predetermined relationship to each other with each of the trackers providing mounting for a laser tracker transmitter, a laser detector receiver, a continuous wave laser transmitter, and a continuous wave laser detector. The output from the laser tracker detector is used to provide an output through tracker instrumentation to generate an output for maintaining the tracker on track of the missile and to provide an output of azimuth and elevation angles plus range information to storage means. The laser tracker transmitter sends out laser pulses to a retroreflector on the missile which returns the signal to the laser tracker detector. The missile also has a single plane corner reflector array in the skin thereof which is illuminated by the continuous wave laser on the trackers and the single plane corner reflector reflects back light to the continuous wave detector on the respective tracker when the missile has rotated to a position for reflecting the continuous wave laser light back to the respective tracker. The continuous wave detector on each of the trackers produces signals and sends them to an attitude determination support unit to correlate data between the three continuous wave detector units and provide this data on the storage means such as a recorder or computer for recording or computing the attitude of the missile. Once the attitude of the missile is computed and compared to a predetermined trajectory present in the computer, the computer then computes error signals that are transmitted by a laser radar or other uplink means to detector on board the missile to cause control means on board the missile to correct the attitude of the missile toward a predetermined target.

DESCRIPTION OF THE PREFERRED EMBODIMENT

Figure 1:
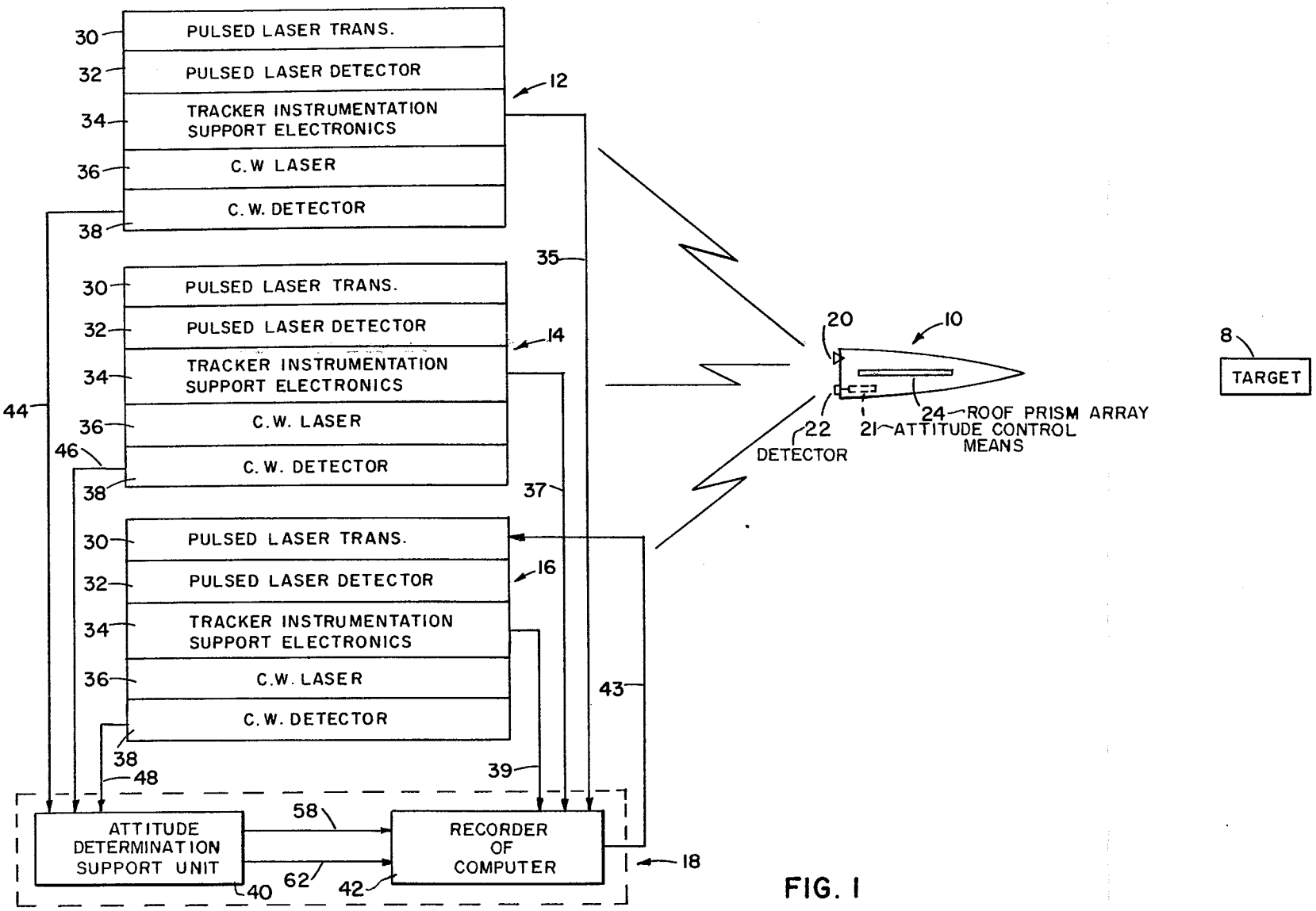
FIG. 1 is a pictorial view of a missile system according to this invention.

Referring now to FIG. 1, a system according to this invention is pictorially illustrated and includes a target 8, a missile 10, trackers 12, 14 and 16, and storage means 18 such as recording or computer means. Missile 10 has corner cube retroreflector means 20, correction detector means 22 and roof prism array reflector 24 that is mounted in the skin of the missile along an axis that is longitudinal to the axis of the missile and in a generally singular plane. Detector means 22 controls actuation of appropriate control means 21 in the missile for correcting the attitude of the missile.

Each laser tracker 12, 14 and 16 contains a pulse laser transmitter 30, a pulse laser detector 32, tracker instrumentation support electronics 34, continuous wave laser transmitter 36 and continuous wave detector 38. Tracker instrumentation support electronics 34 operate to drive the mount for its respective laser tracker and maintain the laser signal on track of the missile and it also produces an output to storage means 18 that gives the azimuth and elevation angles plus range. This is accomplished by pulse laser transmitter 30 transmitting a laser signal to corner reflector means 20 and being received by pulse laser detector 32 which provides the detected signal to tracker instrumentation support electronics 34. Each of units 12, 14 and 16 independently track missile 10.

Each laser tracker 12, 14 and 16 also has a continuous wave laser transmitter 36 that illuminates roof prism array 24 each time array 24 rotates into view of the respective continuous wave laser signal. The reflection from array 24 to the respective continuous wave detector 38 is used to produce a signal to an attitude determination support unit 40 of storage means 18. Outputs 58 and 62 from attitude determination support unit 40 and the azimuth and elevation angles plus range outputs 35, 37 and 39 from respective tracker instrumentation support electronics 34 are received by recorder or computer 42 which either records the data received or computer correction signals for correction of the missile attitude. If item 42 is a computer, the output data is correlated and compared with a predetermined trajectory from missile 10 to target 8 to produce an output signal 43 to cause correction signals to be transmitted such as through coded signals from one of pulse lasers 30 to detecting means 22 on board missile 10 which causes appropriate control means 21 on missile 10 to be actuated and cause missile 10 to be put on course with target 8.

Figure 2:
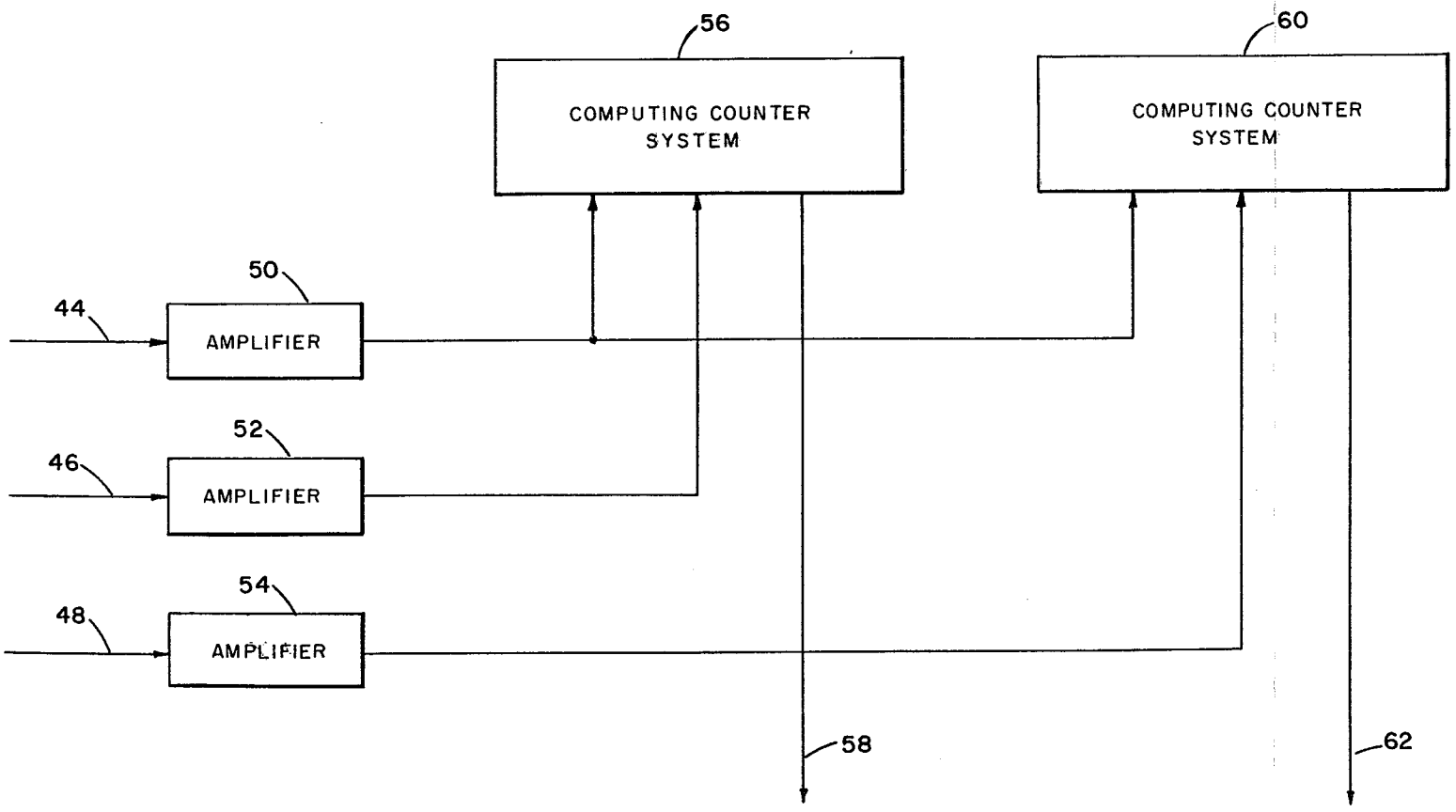
FIG. 2 is a schematic illustration of an attitude determination unit.

Attitude determination support unit 40 may be a master clock type device as illustrated in FIG. 2 which includes inputs 44, 46 and 48 from continuous wave detectors 38 of tracker units 12, 14 and 16 respectively. Inputs 44, 46 and 48 are each passed through pulse shaping and conditioning amplifiers 50, 52 and 54. Inputs 44 and 46 from amplifiers 50 and 52 are processed by computing counter system 56 which may be a Hewlett Packard 5360 series computing counter system to produce an output 58 which is a time interval between pulses from inputs 44 and 46 in digital format. Inputs 44 and 48 are transmitted to computing counter system 60 which also may be a Hewlett Packard 5360 series type computing counter system to produce output 62 which is a time interval between input 44 and 48 represented in digital format. As can be seen, each revolution of missile 10 results in pulses being received by the continuous wave detectors 38 of trackers 12, 14 and 16 to cause outputs 58 and 62 to represent signals which are coupled to represent pitch and yaw data from missile 10. It is also pointed out that trackers 12, 14 and 16 are mounted in a predetermined relationship as to distance relative to each other and this information as well as the target data are programmed into computer 42.

In operation, assuming that missile 10 has been launched and is rotating at a predetermined rate, and laser trackers 12, 14 and 16 have been trained on missile 10, pulse laser transmitter 30 transmit signals to reflector 20 which reflects the signals back to the respective pulse laser detectors 32. The signals detected at pulse laser detectors 32 supply signals to tracker instrumentation support electronics 34 of each tracker to maintain the tracker on track of missile 10. Each tracker instrumentation support electronics unit 34 also supplies an output as azimuth and elevation angles plus range signal to recorder or computer 42. At the same time, continuous wave lasers 36 of each of the trackers are trained on missile 10 and when missile 10 rotates roof prism array 24 into the plane of continuous wave laser beam from each of the respective trackers, a signal is reflected back to the respective continuous wave detector 34. Due to the spacing of laser trackers 12, 14 and 16 in a predetermined relationship to each other, only one continuous wave laser signal is reflected back to continuous wave detector 38 of a respective tracker depending upon the particular rotational position of missile 10 relative to the tracker at a time. During each revolution of missile 10, each continuous wave detector 38 receives a reflected signal from roof prism array 24 and produces signals to the attitude determination support unit 40 which produces signals 58 and 62 as functions of pitch and yaw of missile 10. Recorder or computer 42 either records the data from the tracker instrumentation support electronics units 34 and the signals from the continuous wave detector units 38 to be used at a later time to study the flight of a missile or if section 42 is a computer, the computer correlates the data received with a predetermined trajectory to target 8 and generates correction signals that are transmitted through pulse laser 30 in coded form to code detector 22 which receives the coded signals and actuates appropriate control means 21 on missile 10 to direct missile 10 into a trajectory to target 8. Multiple trajectory corrections of the missile relative to the target can be made with this system to maintain the missile on course to the target.

We claim:

1. A method for detecting the attitude of a launched missile relative to a predetermined trajectory to a target comprising tracking said missile with a plurality of laser trackers to produce azimuth and elevation angles plus range data of said missile at each tracker location, said missile having an outer skin with a single plane roof prism array mounted therein along an axis that is generally longitudinal to an axis of the missile, illuminating said roof prism array on said missile with a continuous wave laser of each of said plurality of laser trackers as said missile rotates said roof prism array into view of said continuous wave laser of each of said plurality of said laser trackers, detecting the reflections of each continuous wave laser of each of said laser trackers to enable the production of signals that are processed into yaw and pitch signals for the missile, and storing in storage means, as received data, the azimuth and elevation angles plus range data of said missile and the yaw and pitch signals from the detecting of the reflections received at each laser tracker location.

2. A method for detecting the attitude of a missile to a target as set forth in claim 1, wherein said storage means includes a recorder for recording the received data.

3. A method for detecting the attitude of a missile to a target as set forth in claim 1, wherein said storage means includes a computer that analyzes the received data and computes correction signals for correcting the trajectory of said missile in accordance with a predetermined trajectory to a target, transmitting said correction signals through transmitting means to a detector on said missile, and said detector actuating control means on said missile for correcting the trajectory of said missile.

4. A method for detecting the attitude of a missile to a target as set forth in claim 3, wherein said plurality of laser trackers are three in number, and the continuous wave detector signals from each of said plurality of laser trackers are processed through computing counter system means to produce outputs in digital format that represent said pitch and yaw signals to said computer.

* * * * *